US012790154B2

(12) United States Patent
Cianci et al.

(10) Patent No.: US 12,790,154 B2
(45) Date of Patent: Nov. 10, 2026

(54) METHOD AND MACHINE FOR PRODUCING CELLULOSE FLUFF

(71) Applicant: Fameccanica.Data S.p.A., San Giovanni Teatino Chieti (IT)

(72) Inventors: Enio Giovanni Cianci, San Giovanni Teatino Chieti (IT); Alessandro Cipriani, San Giovanni Teatino Chieti (IT); Renzo Blasioli, San Giovanni Teatino Chieti (IT)

(73) Assignee: Fameccanica.Data S.p.A.

( * ) Notice: Subject to any disclaimer, the term of this patent is extended or adjusted under 35 U.S.C. 154(b) by 80 days.

(21) Appl. No.: 19/101,773

(22) PCT Filed: Jul. 11, 2023

(86) PCT No.: PCT/IB2023/057108

§ 371 (c)(1),
(2) Date: Feb. 6, 2025

(87) PCT Pub. No.: WO2024/033725

PCT Pub. Date: Feb. 15, 2024

(65) Prior Publication Data

US 2026/0048955 A1 Feb. 19, 2026

(30) Foreign Application Priority Data

Aug. 8, 2022 (IT) ..... 102022000016914
Aug. 8, 2022 (IT) ..... 102022000016926

(51) Int. Cl.
*B32B 41/00* (2006.01)
*B65H 19/18* (2006.01)
*D21B 1/06* (2006.01)

(52) U.S. Cl.
CPC ..... *B65H 19/1842* (2013.01); *D21B 1/066* (2013.01); *B65H 2301/4631* (2013.01); *B65H 2701/177* (2013.01)

(58) Field of Classification Search
CPC ..... B65H 19/1842; B65H 2301/4631; B65H 2701/177; B65H 2301/46176;
(Continued)

(56) References Cited

U.S. PATENT DOCUMENTS

2013/0014899 A1* 1/2013 Nakano ..... A61F 13/15642 156/361

FOREIGN PATENT DOCUMENTS

| | | | |
|---|---|---|---|
| EP | 3682857 | A1 | 7/2020 |
| WO | 2011114254 | A1 | 9/2011 |
| WO | 2015071839 | A1 | 5/2015 |

OTHER PUBLICATIONS

Search Report dated Oct. 9, 2023. 13 pages.

* cited by examiner

*Primary Examiner* — Michael N Orlando
*Assistant Examiner* — Joshel Rivera
(74) *Attorney, Agent, or Firm* — RMCK Law Group PLC

(57) ABSTRACT

A method for joining together two webs includes: overlapping a head portion of the second web on a tail portion of the first web, jointly cutting the head portion of the second web and the tail portion of the first web along a cutting line, so as to form on the first web and on the second web respective front edges offset from each other, and applying a first adhesive splicing tape between a head end of the second web and a tail end of the first web and at the same time aligning frontally with each other the front edges of the first and the second webs.

18 Claims, 6 Drawing Sheets

(58) Field of Classification Search
CPC ..... B65H 2406/31; B65H 2801/84; B65H 19/1873; B65H 19/1852; D21B 1/066
USPC ..... 156/60, 64, 350, 351, 378, 379
See application file for complete search history.

METHOD AND MACHINE FOR PRODUCING CELLULOSE FLUFF

CROSS-REFERENCE TO RELATED APPLICATIONS

This application is a 371 National Stage of International Application No. PCT/IB2023/057108, filed Jul. 11, 2023, which claims priority to Italian Patent Application No. 102022000016914 filed Aug. 8, 2022 and 102022000016926 filed Aug. 8, 2022. The disclosure of each of the above applications is incorporated herein by reference in its entirety.

FIELD OF THE INVENTION

The present invention relates to a method and machine for producing cellulose fluff.

The invention has been developed, in particular, for the application to machines for producing absorbent articles.

However, the invention is not limited to this specific field of use.

DESCRIPTION OF THE PRIOR ART

Cellulose fluff is an absorbent material in flakes used for producing absorbent articles of various types, such as diapers, sanitary articles for adults, absorbent towels, etc.

The cellulose fluff is obtained starting from continuous cellulose webs having a thickness in the order of 1-1.5 mm wound in reels.

The conversion of the cellulose webs into cellulose fluff is carried out in defibrator mills. Typically, a defibrator mill has a stationary casing and a toothed rotor rotating within the casing. The rotor teeth impact on one end of a web which is fed into a defibration chamber.

An example of a defibrator mill for producing cellulose fluff is described in EP-A-2039827 by the same Applicant.

Typically, a defibrator mill has two inlets for two cellulose webs coming from two reels loaded on respective spindles. The quantity of defibrated material depends on the feed speed with which the web is inserted into the defibrator mill. During operation, a first web advances inside the defibrator mill and a second web is waiting. When the reel from which the first web unwinds is running out, the feeding system of the second web is activated. During the reel change, the feed speed of the first web decreases while the feed speed of the second web increases. The feed speeds of the two cellulose webs are synchronized so as to have a production of cellulose fluff with a constant flow rate during the change of the reels. When the first web stops, the second web reaches the working speed. At this point, the elimination of the core of the first finished reel is carried out, with the insertion of a new reel.

In recent years, there has been an increasing demand for apparatuses capable of producing cellulose fluff formed by a mixture of two different cellulose fibers. In particular, there is a demand for apparatuses capable of producing cellulose fluff containing long-fiber cellulose and short-fiber cellulose. Long-fiber cellulose typically has a fiber length of about mm and is typically formed of pine cellulose. Short-fiber cellulose typically has a fiber length of about 2 mm and is typically formed of eucalyptus cellulose.

This demand stems from the fact that eucalyptus cellulose is less expensive and more sustainable since eucalyptus plants take fewer years than pine plants to reach maturity. On the other hand, short-fiber cellulose has lower liquid carrying capacity, absorbency and integrity, and adequate fluid handling performance cannot be obtained using only short-fiber cellulose.

It was found d that a 50/50 blend of long-fiber cellulose and short-fiber cellulose would have acceptable fluid handling performance and have a positive impact on cost reduction and sustainability.

One of the problems of the current state of the art for producing cellulose fluff is that the defibrator mills do not allow production of cellulose fluff formed by a mixture of two different cellulose fibers. In fact, to produce cellulose fluff containing a mixture of different cellulose fibers it would be necessary to feed the defibrator mill simultaneously with two webs of cellulose of different types. However, in this way it would not be possible to manage the change of the reels without stopping the feed of the mill.

OBJECT AND SUMMARY OF THE INVENTION

The object of the present invention is to overcome the problems of the prior art.

According to the present invention, this object is achieved by a method having the characteristics forming the subject of claim 1.

According to another aspect, the invention relates to a machine for producing cellulose fluff having the characteristics of claim 10.

Preferred embodiments of the invention form the subject of the dependent claims.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

It will be appreciated that the accompanying drawings are schematic and that some components may not be shown to assist in understanding the Figures. Also, it will be appreciated that the various figures may not be represented on the same scale.

DETAILED DESCRIPTION

Figure 1:
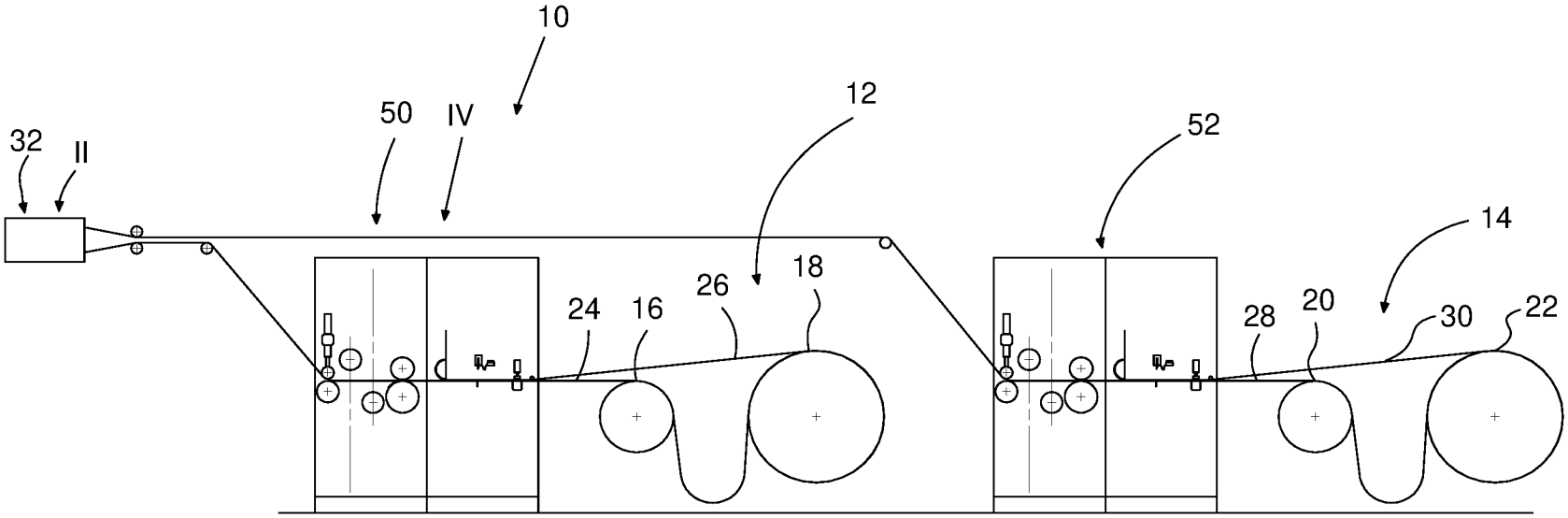
FIG. 1 is a schematic side view of machine for producing cellulose fluff.

With reference to FIG. 1, numeral 10 indicates a machine for producing cellulose fluff. The machine 10 comprises a first reel-holder assembly 12 in which a first reel 14 and a second reel 16 are arranged, and a second reel-holder assembly 18 in which a third reel 20 and a fourth reel 22 are arranged. Each of the reel holders has a first station for a reel being unwound and a second station for a waiting reel. The first, second, third and fourth reels 14, 16, 20, 22 contain respectively a first, second, third and fourth web 24, 26, 28, 30.

During operation, the first reel 14 and the third reel 20 are simultaneously being unwound and the second reel 16 and the fourth reel 22 are waiting. When the first reel 14 and the third reel 20 are nearly finished, tail portions of the first and third web 24, 28 are spliced, respectively, to head portions of the second and fourth web 26, 30 in the manner described below.

Figure 3:
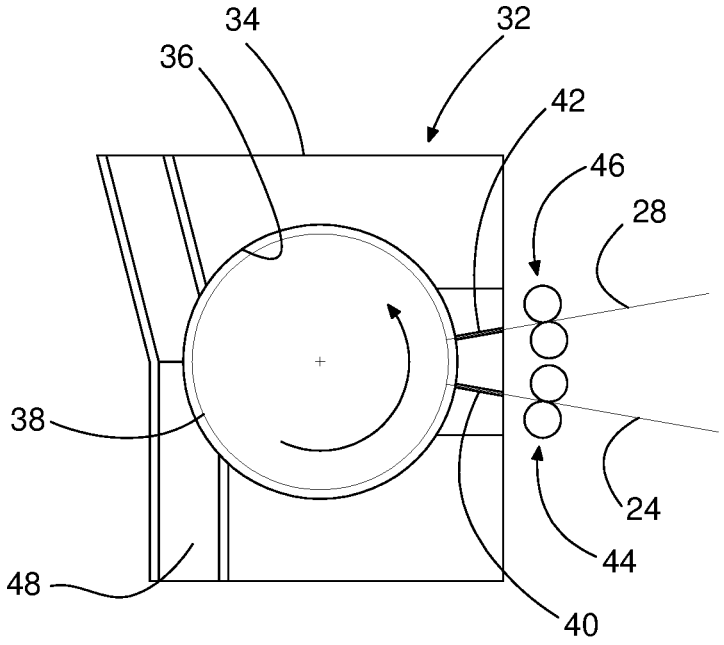
FIG. 3 is a schematic cross-section along the line III-III of FIG. 2.

The machine 10 comprises a defibrator mill 32 suitable for defibrating cellulose webs to produce cellulose fluff. With reference to FIG. 3, the defibrator mill 32 comprises a stationary casing 34 having a chamber 36 in which a sprocket 38 rotates. The stationary casing 34 has two inlets 40, 42 through which the first and third web 24, 28 are fed by respective feeding devices 44, 46. The sprocket 38 defibrates the cellulose webs 24, 28 and forms cellulose fluff which is extracted from the chamber 36 through an outlet channel 48.

The first and third webs 24, 28 may be made of different materials. For example, the first web 24 may be made of long-fiber cellulose (e.g. pine cellulose) and the second web 24 may be made of short-fiber cellulose (e.g. eucalyptus cellulose).

In a possible embodiment, the machine 10 may operate with two webs made of the same material. This has the advantage that it is possible to feed the webs at reduced speed (at half the speed) with respect to the speed that would be required if the mill were to feed only one web at a time.

The replacement reels 18, 22 may be made of the same material as the reels they replace or of a different material.

During operation, the first and third webs 24, 28 are fed simultaneously into the defibrator mill 32, so that the cellulose fluff that is produced is formed by a mixture of long-fiber cellulose and short-fiber cellulose. The composition of the cellulose fluff mixture may be varied by changing the relative speed of the feed devices 44, 46. The cellulose webs may have a weight in the order of 500-900 gsm and a thickness in the order of 1-1.5 mm.

With reference to FIG. 1, the machine 10 comprises a first and a second splicing apparatus 50, 52, configured for automatically joining the tail portions of the first and third webs 24, 28 to the head portions of the second and fourth webs 26, 30, respectively. The two splicing devices 50, 52 are identical to each other. The structure and operation of only one of the splicing devices 50, 52 will be described below, and it is understood that what has been described for one of them also applies to the other.

Figure 4:
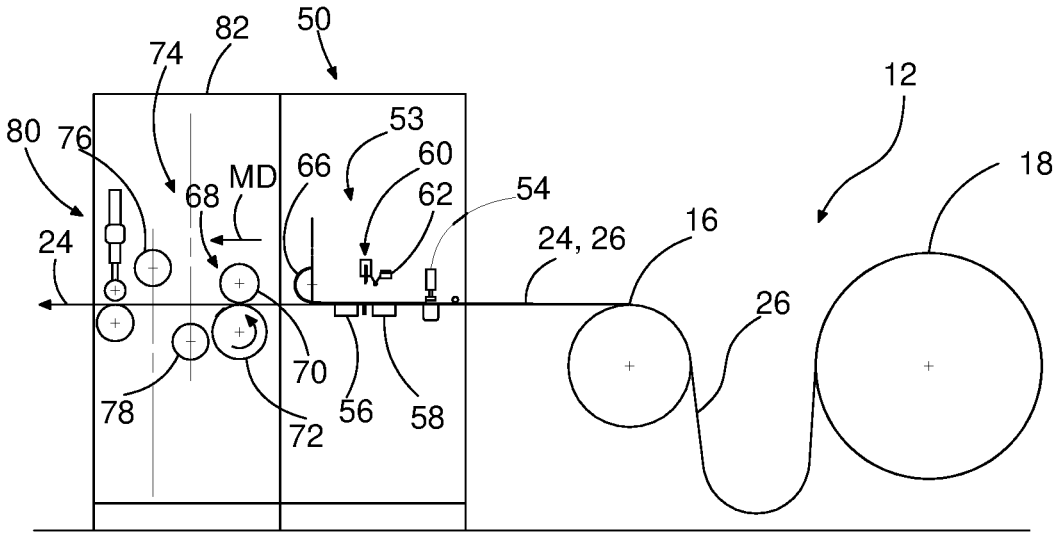
FIGS. 4-10 are side views of the part indicated by the arrow IV in FIG. 1 illustrating the joining sequence of two webs.

With reference to FIG. 4, the first splicing apparatus 50 comprises a stop unit 53 configured to hold a tail portion of the first web 24 and a head portion of the second web 26 in a stationary condition in an overlapping position.

The stop unit 53 comprises a blocking device 54 configured to lock superimposed portions of the first and second webs 24, 26 together. The blocking device 54 is located in an inlet section of the splicing apparatus 50 and is movable between an unlocked position and a locked position and may be controlled by a pneumatic actuator.

The stop unit 53 comprises two suction nozzles 56, 58 located downstream of the blocking device 54 with reference to the machine direction MD and configured to hold respective sections of the first web 24 by suction.

The stop unit 53 comprises a retaining device 66 located downstream of the cutting device 60 with reference to the machine direction MD and configured to retain, for example by suction, a head portion of the second web 26.

The splicing apparatus 50 comprises a cutting device 60 located downstream of the blocking device 54 with reference to the machine direction MD, and configured to cut the overlapping portions of the first and second webs 24, 26. The cutting device 60 is configured to make a through-cut which extends between two opposite side edges of the first and second webs 24, 26. The cutting device 60 is configured to cut between the two suction nozzles 56, 58. During execution of the cut, the head portion of the second web 26 and the tail portion of the first web 24 are held both upstream and downstream of the cutting line.

The splicing apparatus 50 comprises a first applicator device 62 located above the suction nozzles 56, 58 and movable between a raised position and a lowered position and configured to apply a first adhesive splicing tape between a tail end of the first web 24 and a head end of the second web 26.

The splicing apparatus 50 comprises a second applicator device 68 located downstream of the cutting device 60 with reference to the machine direction MD and configured to apply a second adhesive splicing tape between a tail end of the first web 24 and a head end of the second web 26 in an opposite position to the first splicing tape. The second applicator device 68 comprises a motorized roller 70 and an applicator roller 72 moveable relative to each other between an open position and a closed position. The applicator roller 72 is configured to retain, for example by suction, a second adhesive splicing tape.

The splicing apparatus 50 comprises a buffer 74 located downstream of the stop unit 53 with reference to the machine direction MD and configured to accumulate a predetermined length of the first web 24. The buffer 74 comprises two rollers 78, 76 movable relative to each other in the vertical direction between an inoperative position and an accumulation position.

The splicing apparatus 50 also comprises an outlet feeder device 80 located downstream of the buffer 74 with reference to the machine direction MD, and configured to feed the first and second webs 24, 26 in the machine direction MD.

The various devices of the splicing apparatus 50 are carried by a stationary support frame 82.

The operation of the splicing apparatus 50 is as follows.

In the configuration shown in FIG. 4, the splicing apparatus 50 is in the position for preparing the reel change. In this configuration, the first web 24 that unwinds from the first reel 16 is fed to the defibrator mill and passes through the splicing apparatus 50 in the machine direction MD. In this configuration, the blocking device 54 is in the unlocked position, the rollers 70, 72 of the second applicator device 68 are in the open position and allow the first web 24 to pass freely, and the buffer 74 is in the inoperative position.

While the first web 24 is being unwound from the first reel 16, an operator takes the head end of the second web 26, passes it through the blocking device 54 and positions it on the retaining device 66 which holds it in a stationary position, for example by suction.

Figure 11:
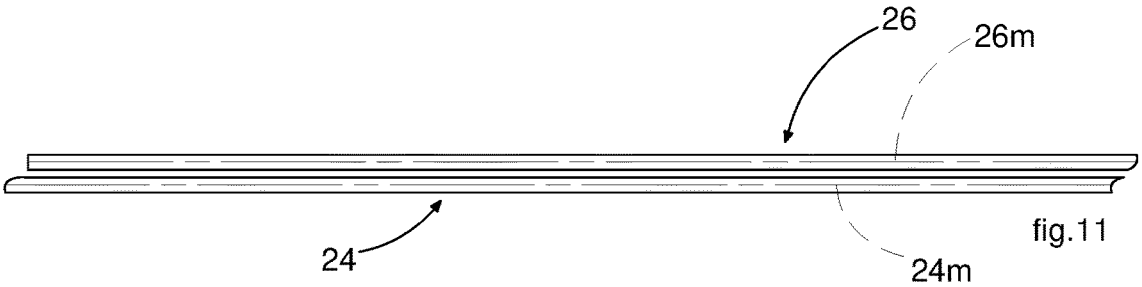
FIGS. 11-13 are schematic side views illustrating some steps of the method for joining two webs.

In this condition, the first and second webs 24, 26 are in the position schematically shown in FIG. 11. A head portion of the second web 26 is superimposed on a tail portion of the first web 24. The head portion of the second web 26 and the tail portion of the first web 24 have respective median planes 26*m* and 24*m* parallel and spaced apart from each other. In a possible embodiment, the tail portion of the first web 24 extends in a horizontal direction and the head portion of the second web 26 extends above the tail portion of the first web 24.

The operator also applies a first adhesive splicing tape on the first applicator device 62, and a second adhesive splicing tape on the applicator roller 72 of the second applicator device 68. The applicator roller 72 may translate axially to facilitate the application thereon of the second adhesive splicing tape. The first and second adhesive splicing tape may be held by suction on the first applicator device 62 and on the applicator roller 72 of the second applicator device 68.

At this point the machine is ready to change the reels.

A diameter sensor located at the first reel 16 signals when the first reel 16 is close to finishing.

Figure 5:
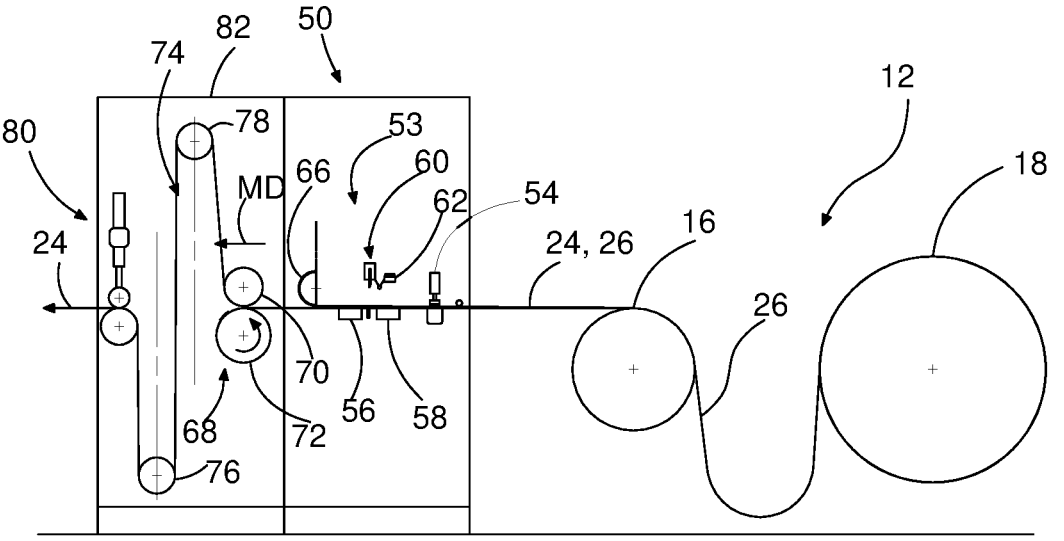

At this point, as shown in FIG. 5, the two rollers 78, 76 of the buffer 74 translate on their respective guides in the vertical direction in opposite directions and accumulate a predetermined length of the first web 24. In this step, the two rollers of the outlet feeder device 80 close and squeeze the first web 24 between them and feed the first web 24 at a constant speed. The motorized roller 70 of the second applicator device 68 accelerates so as to facilitate the accumulation of the first web 24 in the buffer 74.

Figure 6:
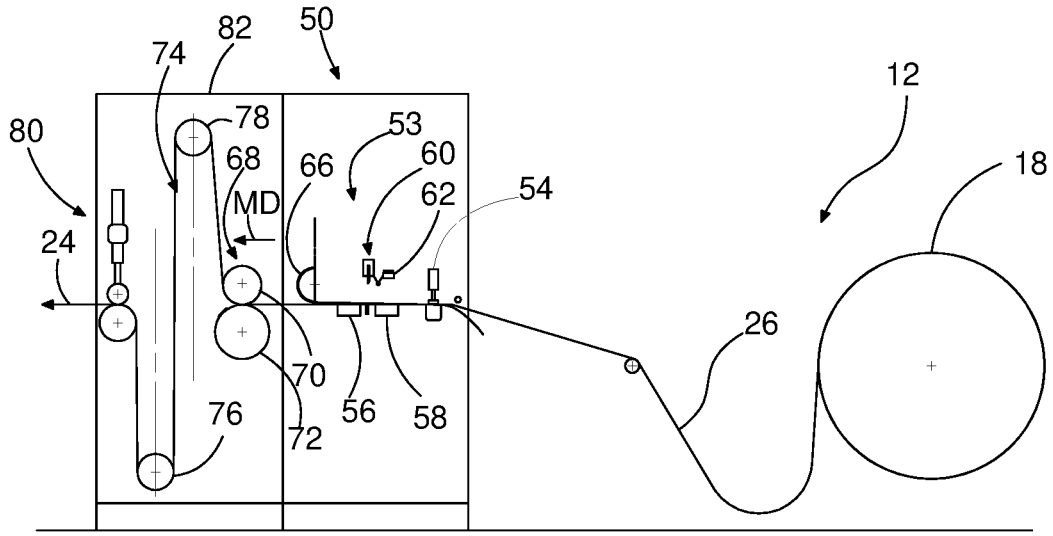

With reference to FIG. 6, once the accumulation of the first web 24 in the buffer 74 is completed, the first reel 16 is finished. At this point the motorized roller 70 stops and closes on the applicator roller 72 and stops the advancement of the first web 24 upstream of the buffer 74. The outlet feeder device 80 continues to feed the first web 24 at a constant speed, keeping the feed of the defibrator mill 32 constant, so that the buffer 74 begins to reduce the length of the first web 24 contained therein.

Once the speed of the first web 24 upstream of the buffer 74 is equal to zero, the vacuum is activated on the suction nozzles 56, 58 and the blocking device 54 is closed. In the section between the blocking device 54 and the second applicator device 68, the first and second webs 24, 26 are held in a stationary position and superimposed on each other.

Figure 7:
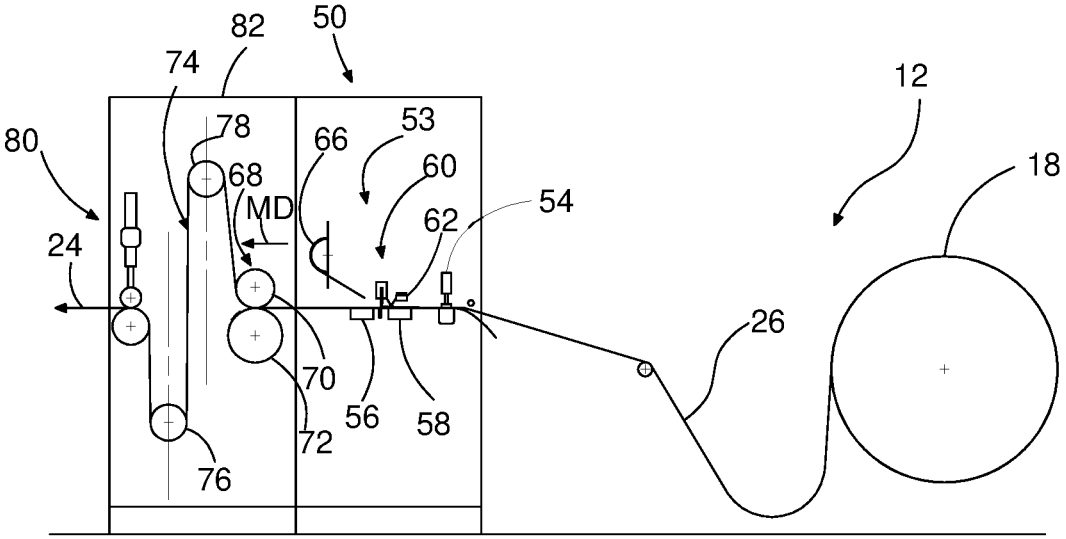

With reference to FIG. 7, in this condition the cutting device 70 is activated and jointly cuts the first and second webs 24, 26.

Figure 12:
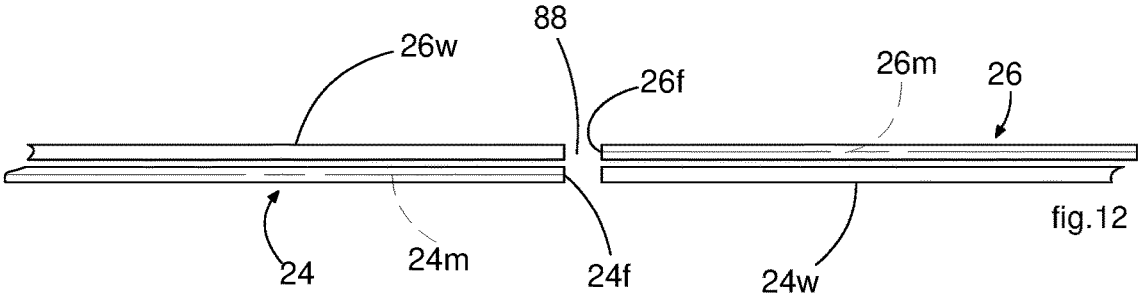

The cut forms front ends 24*f*, 26*f* on the first and second webs 24, 26. In the configuration of FIG. 12 the front ends 24*f*, 26*f* are offset from each other. In this condition, the median planes 24*m* and 26*m* of the first and second webs 24, 26 are parallel and spaced apart.

Figure 2:
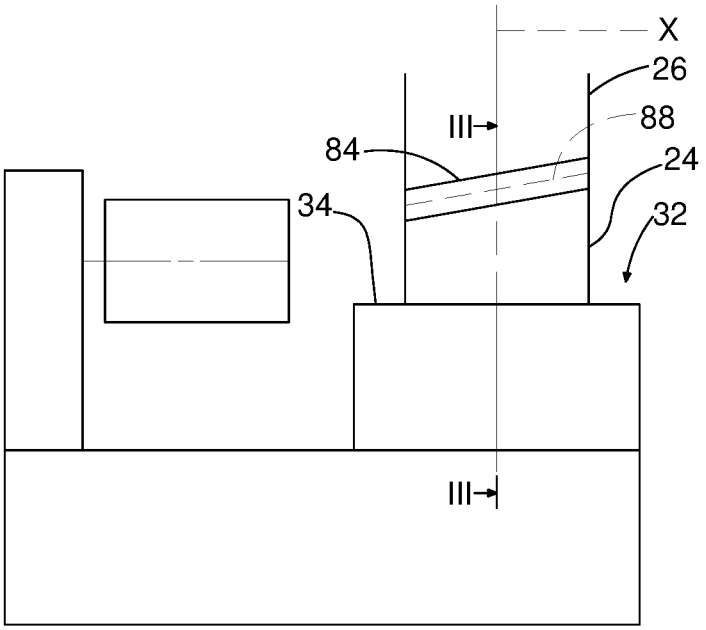
FIG. 2 is a plan view of the part indicated by the arrow II in FIG. 1.

The two webs 24, 26 may be cut along a cutting line (indicated with 88 in FIG. 2) inclined with respect to a direction perpendicular to the longitudinal axes of the two webs 24, 26. With reference to FIG. 2, the cutting line 88 may be inclined by 10-15° with respect to a direction perpendicular to the longitudinal axis X of the two webs 24, 26.

After the cut, the first and second webs 24, 26 are in the position schematically shown in FIG. 12. A section 26*w* of the head portion of the second web 26 located downstream of the cutting line 88 and a section 24*w* of the tail portion of the first web 26 located upstream of the cutting line 88 are intended to be discharged as scraps.

Figure 8:
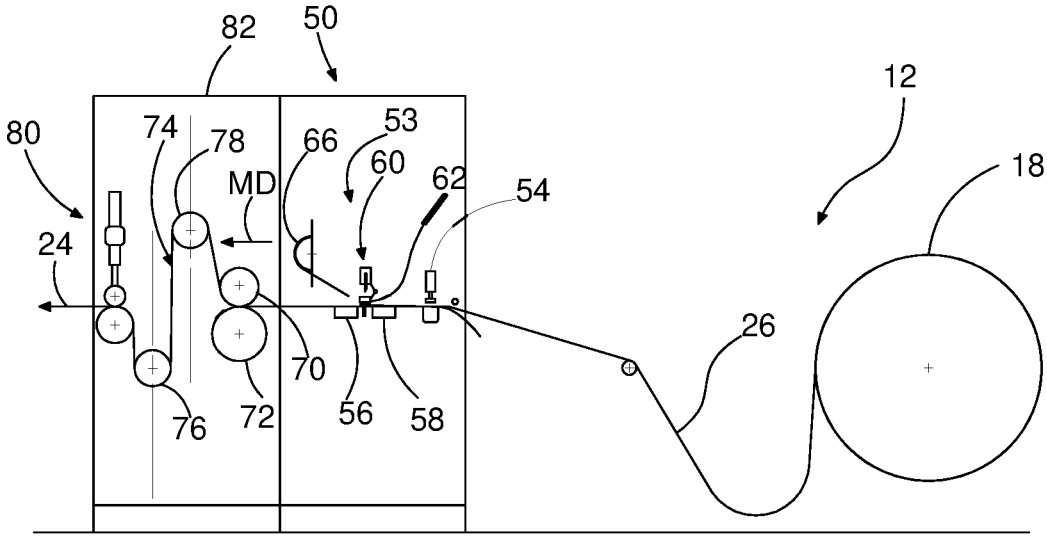
Figure 13:
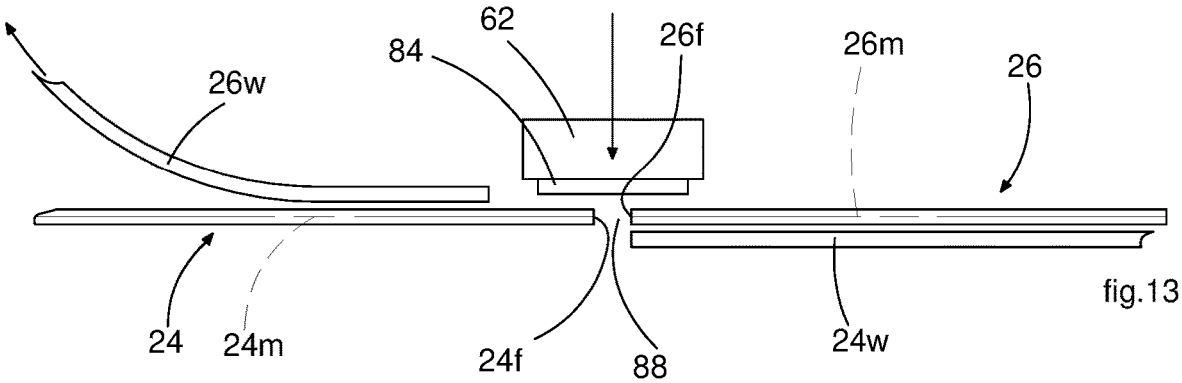

With reference to FIGS. 8 and 13, after the cut, the retaining device 66 which holds the head portion of the second web 26, translates upwards and disengages the section 26*w* from the remaining part of the head portion of the second web 26.

At this point, as shown in FIGS. 8 and 13, the first applicator device 62 presses downwards the end of the second web 26 adjacent to the cutting line and brings the front edge 26*f* of the second web 26 into a position facing the front edge 24*f* of the first web 24. In this condition, the median planes 24*m* and 26*m* of the first and second webs 24, 26 are coplanar with each other. The section 24*w* of the tail portion of the first web 24 moves downwards to make room for the second web 26. The downward displacement of the section 24*w* may be allowed by the deformability of the suction nozzle 58 which supports the section 24*w* in the vicinity of the cutting line.

At the same time, the first applicator device 62 applies a first adhesive splicing tape 84 astride the front ends 24*f*, 26*f* of the first and second webs 24, 26 facing each other, and the tail end of the first web 24 is joined to the head end of the second web 26.

At this point, the vacuum on the suction nozzles 56, 58 is deactivated and the blocking device 54 is opened to release the webs 24, 26.

Figure 9:
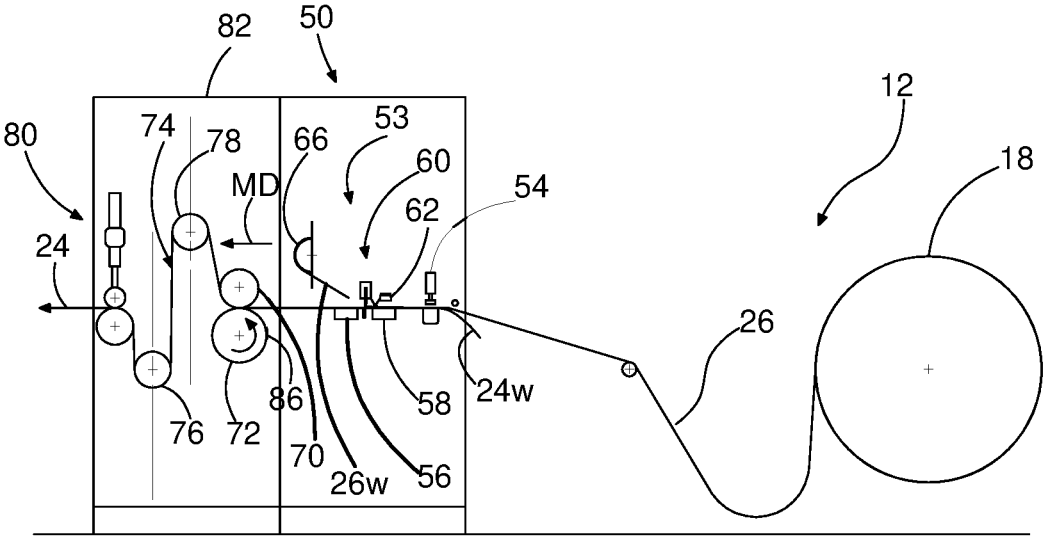

Then, as shown in FIG. 9, the motorized roller 70 of the second applicator device 68 is pressed against the applicator roller 72, so as to form a nip into which the first web 24 is pressed. Then, the motorized roller 70 is driven to rotate.

The position of the second splicing tape 86 on the surface of the applicator roller 72 is timed so that the arc length between the center of the second splicing tape 86 and the nip between the two rollers 70, 72 is equal to the distance between the nip and the joint line between the first and second web 24, 26. In this way, the second splicing tape 86 is applied astride the joint line, in an opposite position to the first splicing tape 84.

At this point the first and second webs 24, 26 are fixed together by an upper splicing tape 84 and a lower splicing tape 86.

During all the previous operations, the defibrator mill 32 is fed by the web accumulated by the buffer 74, which has finished in the meantime.

Figure 10:
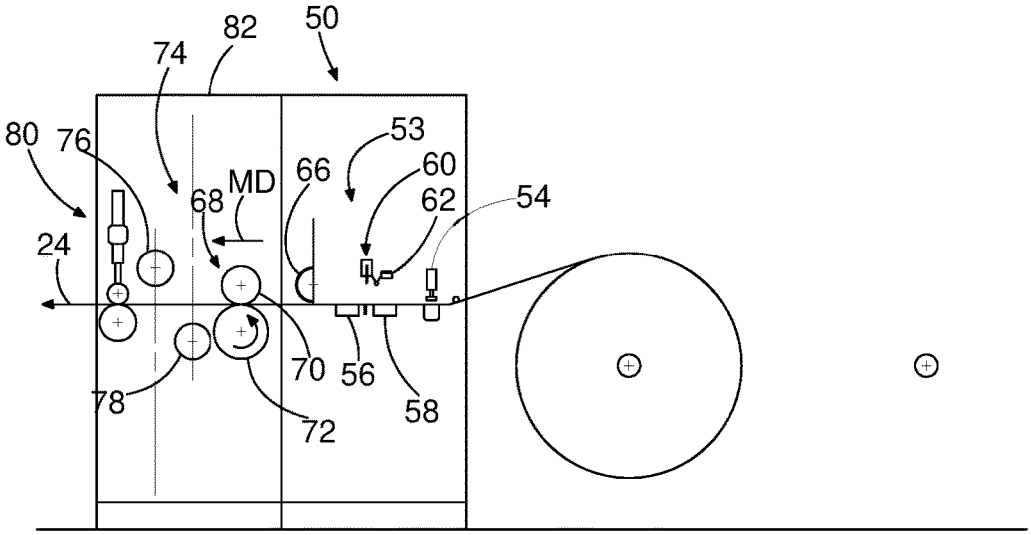

With reference to FIG. 10, in the step wherein the joint line passes towards the defibrator mill 32, the motorized roller 70 and the outlet feeder device 80 remain active and push the joined web 24, 26 with a higher speed than the speed at which the web is pulled by the defibrator mill, to prevent the tension from tearing the joint. This allows the tension on the web to be kept low, avoiding stress on the joint area.

With reference to FIGS. 9 and 10, once the reels have been changed, the operator may remove the head and tail sections 26*w* and 24*w*, which are discarded as scraps. The operator also removes the core of the finished reel and translates the new reel 16 into the unwinding position. The reel-holder is made in such a way that the reels may move from the waiting position to the unwinding position, so that splicing can always be carried out in the same sequence, unlike what happens in solutions wherein the reels are mounted on fixed spindles, which require different splicing sequences depending on where the reel being unwound is positioned.

Each of the two splicing devices 50, 52 during operation implements a method for splicing two webs together, comprising:

providing a first and a second web 24, 26, overlapping a head portion of the second web 26 on a tail portion of the first web 24.

holding a head portion of the second web 26 with a tail portion of the first web 24 in a stationary position, jointly cutting the head portion of the second web 26 and the tail portion of the first web 24 along a cutting line 88, so as to form on the first web 24 and on the second web 26 respective front edges 24*f*, 26*f* offset from each other, applying a first adhesive splicing tape 84 between a head end of the second web 26 and a tail end of the first web 24 and—at the same time—aligning frontally with each other the front edges 24*f*, 26*f* of the first and the second webs 24, 26.

The head joint without overlapping between the two webs allows continuity of operation of the defibrator mill and avoids the entry into the mill of a web section with two overlapping layers, which would involve risks of malfunctions, irregular production of fluff and risks of jamming.

The cutting line 88 is preferably inclined with respect to a direction perpendicular to the longitudinal axes X of the first and second webs 24, 26. If the cutting line were perpendicular to the longitudinal axes X of the first and second webs 24, 26, at the time of entry into the defibrator mill 32, the joint between the first and second webs 24, 26 would be interrupted and the continuity between the two webs would be lost, which could lead to the risk of jamming the webs in the defibrator mill 32.

Of course, without prejudice to the principle of the invention, the details of construction and the embodiments can be widely varied with respect to those described and shown, without thereby departing from the scope of the invention as defined by the claims that follow.

The invention claimed is:

1. A method for producing cellulose fluff, comprising:
providing a defibrator mill having two inlets,
simultaneously feeding a first web and a third web to respective inlets of the defibrator mill, and
joining tail portions of the first and third webs to head portions of second and fourth webs,
wherein said joining step comprises:
overlapping a head portion of the second or fourth web with a tail portion of the first or third web,
holding a head portion of the second or fourth web with a tail portion of the first or third web in a stationary position,
jointly cutting the head portion of the second or fourth web and the tail portion of the first or third web along a cutting line, so as to form on the first or third web and on the second or fourth web respective front edges offset from each other, and
applying a first adhesive splicing tape between a head end of the second or fourth web and a tail end of the first or third web and at a same time aligning frontally with each other the front edges of the first or third web and the second or fourth web.

2. The method of claim 1, wherein in the overlapping step, the head portion of the second or fourth web and the tail portion of the first or third web have respective median planes parallel and spaced apart from each other, and wherein after the step of frontally aligning with each other the front edges of the first or third web and the second or fourth web, said median planes are coplanar.

3. The method of claim 1, comprising advancing the first or third web in a machine direction, accumulating a predetermined length of the first or third web in a buffer, stopping the tail portion of the first or third web upstream of the buffer and continuing to advance the first or third web downstream of the buffer during the steps of cutting and applying the first adhesive splicing tape.

4. The method of claim 1, comprising applying a second adhesive splicing tape between the head end of the second or fourth web and the tail end of the first or third web in a position opposite to said first adhesive splicing tape.

5. The method of claim 1, wherein said cutting line is inclined with respect to a direction perpendicular to a longitudinal axes of the first or third and second or fourth web.

6. The method of claim 5, wherein said tail portion of the first or third web extends in a horizontal direction, and said head portion of the second or fourth web extends above the tail portion of the first or third web.

7. The method of claim 1, wherein said webs are cellulose webs having a thickness comprised between 1-1.5 mm.

8. The method of claim 1, comprising holding the head portion of the second or fourth web and the tail portion of the first or third web upstream and downstream of said cutting line.

9. The method of claim 1, comprising retaining a portion of the head portion of the second or fourth web located downstream of the cutting line and removing said portion before applying said first adhesive splicing tape.

10. A machine for producing cellulose fluff, comprising:
a defibrator mill having two inlets,
a first reel-holder assembly configured to carry a first reel and a second reel containing, respectively, a first and a second web,
a second reel-holder assembly configured to carry a third reel and a fourth reel containing, respectively, a third and a fourth web, and
a first and a second splicing apparatus, wherein each of said first and second splicing apparatuses comprises:
a stop unit configured to hold in stationary conditions in an overlapping position a tail portion of the first or third web and a head portion of the second or fourth web,
a cutting device configured for jointly cutting the head portion of the second or fourth web and the tail portion of the first or third web along a cutting line, so as to form on the first or third web and on the second or fourth web respective front edges offset from each other, and
a first applicator device configured for applying a first adhesive splicing tape between a head end of the second or fourth web and a tail end of the first or third web and at a same time aligning frontally with each other the front edges of the first or third web and the second or fourth web.

11. The machine according to claim 10, wherein said stop unit comprises a blocking device located in an inlet section of the first splicing apparatus and movable between an unlocking position and a locked position, wherein in the locked position the blocking device is configured to lock superimposed portions of the first or third web and of the second or fourth web together.

12. The machine according to claim 11, wherein said stop unit comprises two suction nozzles located downstream of the blocking device with reference to the machine direction and configured to hold respective sections of the first or third web by suction.

13. The machine according to claim 10, wherein said stop unit comprises a retaining device located downstream of the cutting device with reference to a machine direction and configured to retain a head portion of the second or fourth web.

14. The machine according to claim 10, comprising a second applicator device located downstream of the cutting device with reference to a machine direction and configured to apply a second adhesive splicing tape between a tail end of the first or third web and a head end of the second or fourth web in an opposite position to the first splicing tape.

15. The machine according to claim 14, wherein said second applicator device comprises a motorized roller and an applicator roller movable with respect to each other between an open position and a closed position, wherein the applicator roller is configured to hold the second adhesive splicing tape.

16. The machine according to claim 10, comprising a buffer located downstream of the stop unit with reference to a machine direction and configured to accumulate a predetermined length of the first or third web.

17. The machine according to claim 10, wherein said cutting device is configured to cut along a cutting line inclined with respect to a direction perpendicular to a longitudinal axes of the first or third web and the second or fourth web.

18. The machine according to claim 10, wherein each of said first and second reel-holder assemblies has a first station for an active reel being unwound and a second station for a waiting reel, and wherein the waiting reel in the second station can be moved from the second station to the first station following a finishing of the active reel located in the first station.

* * * * *